US005800228A

United States Patent [19]

Hernandez

[11] Patent Number: 5,800,228

[45] Date of Patent: Sep. 1, 1998

[54] FREE-DRIVER PERMANENTLY WEARABLE SELF-RESCUE SYSTEM

[76] Inventor: Ricardo G. Hernandez, 7401 SW. 129th Ave., Miami, Fla. 33183

[21] Appl. No.: 839,471

[22] Filed: Apr. 14, 1997

[51] Int. Cl.[6] ..... B63C 9/125

[52] U.S. Cl. ..... 441/94; 441/115

[58] Field of Search ..... 441/92, 93, 94, 441/114, 115, 116; 222/5

[56] References Cited

U.S. PATENT DOCUMENTS

| | | | |
|---|---|---|---|
| 3,266,668 | 8/1966 | Davis | 441/95 |
| 3,890,662 | 6/1975 | Roberts | 441/96 |
| 4,097,947 | 7/1978 | Kiefer | 441/116 |
| 4,905,857 | 3/1990 | Her | 220/4 B |

*Primary Examiner*—Sherman Basinger

[57] ABSTRACT

The instant invention offers a permanently wearable self-rescue system for free divers and others engaged in aquatic pursuits to recover to the surface of the water if they should become disabled for any reason. Prior to or during ascent from a dive, if the free-diver has any feeling of insecurity or danger or just wants to insure a totally safe ascent, he or she arms a trigger mechanism that is preferably held in the armed position by the diver's hand grip. If the free-diver should lose consciousness or otherwise be incapacitated, his or her hand grip is released and the trigger mechanism is actuated which results in a resiliently biased puncture pin being propelled to puncture a gas cartridge. Pressurized gas from the cartridge is then directed to an ergonomically designed inflatable bladder garment. The bladder garment is especially designed so that it offers little hydrodynamic resistance when underwater and thus is compatible with the frequent dives taken by free-divers during a typical outing. Further, a locking pin is provided so that the puncture pin can be maintained in a locked or standby position when the free diver does not require or does not want activation of the self-rescue system such as would be the case during normal dives, surface intervals, temporary storage, etc. This locking pin can be either manually or automatically disengaged at any time by the user.

19 Claims, 4 Drawing Sheets

FREE-DRIVER PERMANENTLY WEARABLE SELF-RESCUE SYSTEM

FIELD OF THE INVENTION

The instant invention life saving device is very broadly in the field of inflatable life saving devices. However, it actually differs extensively from prior art inflatable life saving devices in both concept and purpose. It is specifically in the form of a self-rescue system capable of recovering an unconscious free-diver (sometimes referred to as a snorkeler) although it can also be used by other divers. It is designed to be permanently wearable by a diver both on and under the water and is capable of extracting the diver from any depth by means of a self releasing manually controlled trigger mechanism that is preferably configured as a "self-releasing hand held mechanism".

The manually controlled trigger mechanism is normally "passive" or not armed or not engaged during normal free diving activity. In its preferred method of application, it is to be armed or engaged by the diver if the diver feels that he or she may require the instant inventive diver self-rescue system. After engagement or arming, if the diver should lose consciousness or be incapacitated for another reason the diver's grip on the trigger mechanism is released. That action results in a pressurized gas cylinder being punctured so that pressurized gas inflates an ergonomically designed underwater diver compatible bladder garment. That garment, when inflated, will effectively thrust back to the surface and keep floating the incapacitated diver in a breathing position until the diver is recovered and/or regains consciousness. The hydrodynamic design of this retrieval system will not hinder the multiple dives and ascents typical of the aquatic sport known as free-diving.

BACKGROUND OF THE INVENTION

The instant invention offers a means for a diver, particularly a free-diver who dives repeatedly from the surface normally without the aid of compressed air or other artificial breathing means, to recover if the diver should become disabled. It also offers a very valuable new concept self-rescue system for other aquatic pursuits.

It is specifically in the form of a self-rescue system capable of recovering an unconscious free-diver (sometimes referred to as a snorkeler) although it can also be used by other divers. It is designed to be permanently wearable by a diver both on and under the water and is capable of extracting the diver from any depth by means of a self releasing manually controlled trigger mechanism that is preferably configured as a "self-releasing hand held mechanism". A resiliently biased puncture pin mechanism that is designed to puncture a cap of a pressurized gas container is normally locked in position so that it is not armed or not engaged until such time that the free-diver compresses, squeezes, or otherwise activates the self releasing hand held mechanism. If the diver should lose consciousness or be incapacitated for another reason the diver's grip on the self-releasing hand-held mechanism is released. That action results in the cap of the pressurized gas cylinder being pierced by the puncture pin so that pressurized gas inflates an ergonomically designed underwater diver compatible bladder garment. That garment, when inflated, will effectively thrust back to the surface and keep floating the incapacitated diver in a breathing position until the diver is recovered and/or regains consciousness.

The hydrodynamic design of this retrieval system will not hinder the multiple dives and ascents typical of the aquatic sport known as free-diving. It adds a new dimension of safety to the sport of free-diving. As an added safety feature, a mechanism also allows the system to be voluntarily inflated in an emergency or whenever the wearer wishes to do so. Yet another feature is an easy method of replacing spent cartridges to ensure multiple utilization's in the event of inadvertent firing of the self-releasing hand held or trigger mechanism. This is particularly valuable during training sessions for new divers being taught use of the system where the trigger mechanism is fired repeatedly for demonstrations.

There is a particular danger to free-divers by what is known as "Shallow Water Blackout" or SWB. SWB is an extreme and often fatal physiological phenomenon causing an accident that is responsible for a great but undetermined number of death victims among free-divers (snorkelers) of all levels of experience every year. Subsequent "drowning" inevitably occurs as a direct consequence of SWB. A list of some of the conditions that can occur prior to the onset of and contribute to SWB include:

a) Exceeding the estimated time of apnea (breath holding)

b) Excessive underwater physical effort c) Unexpected time-delaying occurrences while underwater d) Sudden physical indisposition, such as cramps, nausea, dizziness due to different factors like exertion, hypothermia (loss of body heat), adverse natural conditions which can include, for example, currents, waves, etc.

The aforementioned conditions, either singularly or in any combination, can result in the free-diver being unable to propel themselves or regain or swim back to the surface. The diver is severely impaired, almost always before reaching the surface and many times only a few feet from the surface, and as a result suffers from a condition known as hipoxemia and cerebral anoxia (lack of oxygen). Unconsciousness settles in and the limp, motionless free-diver's body rapidly starts to sink toward the bottom. After a few moments and as a direct result of the total loss of all voluntary breath holding control, also known as "breaking point or hipercapnia" which is a $CO_2$ excess, the free-diver's natural breathing reflex takes over provoking spasmodic, violent, deep inhalations of water into the lungs and air ways. The result is death by "drowning" and oxygen starvation of the unconscious diver.

The prior art has completely ignored the existing need for the conception of a permanently wearable emergency ascent retrieval system for free-divers. No such specifically and specially conceived for free-divers particular needs safety system exists. This is because none contemplates the necessity and characteristics of free diving. Applicants' invention primarily intends to do so since it will not interfere or hinder the multiple dives and ascents typical of this underwater sport. Every presently existing prior art including Personal Flotation Devices (PFD's), life jackets, inflatable vests, and the like, have been designed and conceived to be used on the surface only. They cannot, nor are they intended to, in any way, shape, or fashion be used by a free-diver to dive with or to be actuated while underwater. They have no other objective but to maintain the user permanently afloat. Since they all are either too bulky, or too cumbersome, or of a loose fit, or possess a permanent degree of positive buoyancy their typical shape and thickness create an excessive hydrodynamic resistance or "water-drag". Their excessive hydrodynamic resistance will render them virtually impossible to use in an underwater free-diving situation. The prior art simply does not have any other obvious or implied alternative uses except to keep someone floating all the time until rescued.

Furthermore, all existing personal flotation or floating devices prior arts are to be put on or donned when an evident conscious recognizable danger of drowning exists. Importantly, they are to be voluntarily activated mostly by means of a pull string, cord, or lever in the cases of such inflatable personal flotation devices.

As an example of an automatic inflatable personal flotation device, there is a life vest automatic inflation device presented by Cleaveland in his U.S. Pat. No. 5,338,239. In his case, a water-soluble tablet 28 dissolves when the life vest is immersed in water thereby actuating a spring loaded puncture pin 22 that punctures a CO2 cartridge 21 which in turn inflates a life vest. This appears a good system for boaters, cruise line passengers, and the like but is totally unworkable system for free divers who, by definition, are totally immersed in water. Cleaveland's patent describes an above water system, as does all of the prior art, so, as such, Cleaveland's patent offers no resemblance to the instant invention.

The present invention offers a life saving solution for free-divers or others engages in aquatic activities who suffer a disability, such as SWB, while underwater. Applicant has coined the acronym SAFER for the instant invention. SAFER is derived from: Shallow water blackout Anti-unconsciousness Fail-safe Emergency ascent Retrieval system. SAFER has application to novice and experienced free-divers alike and should be considered as an essential piece of equipment for free divers who operate independently as well as tourists on dive boats such as operate in abundance in the Florida Keys, the Caribbean, Hawaii, and numerous other parts of the world.

SUMMARY OF THE INVENTION

With the foregoing in mind, it is the principal object of the present invention to provide a permanently wearable self-rescue system for use by divers or others involved in aquatic pursuits that, once it has been armed by the diver and held in the armed position by the diver's hand pressure continuously, is automatically actuated if the user is rendered unconscious or otherwise incapacitated.

It is a related object of the invention that the primary area of diving addressed by this invention is free-diving.

It is a further related object of the invention that its will have its most valuable use when a diver is ascending from a dive.

It is a directly related object of the invention that the free-diver using the invention should activate or arm a trigger mechanism that in turn controls a gas cartridge, normally filled with pressurized CO2 gas, puncture pin mechanism. Arming is normally done just before or during start of ascent from a dive where the diver senses a potentially dangerous outcome for whatever reason including but not limited to dizziness, sense of passing out, a general feeling of insecurity, ineptitude, or hesitation, and the like.

Another object of the invention is that a locking device be provided that locks the gas cartridge puncture pin such that it cannot puncture the cartridge until the locking device is disengaged thereby placing the system in a standby condition.

It is a related object of the invention that disengagement of the locking device can be automatic upon the diver engaging, such as by squeezing a handle, the trigger or emergency actuation system.

It is also an object of the invention that the locking device can be alternatively wholly or at least partially disengaged manually.

It is a related object of the invention that the user can at any time arm the system and then immediately release the trigger all in a matter of only a second or two in an emergency.

Yet a farther object of the invention is that the compact "hand-held" squeeze and hold mechanism eliminates the possibility of accidental inflation caused by entanglement of the ordinary string or cord commonly used in other prior arts.

A further object of the invention is that the diver can reengage the locking device upon reaching the water surface safely.

A very important object of the invention is that the inflatable retrieval system shall be composed of an ergonomically designed bladder garment that will provide a minimum of hydrodynamic resistance when the diver is swimming underwater.

It is a related object of the invention that the ergonomically designed inflatable bladder will assure the safe return and flotation on the surface thus becoming an auto sea rescue system by performing both the extraction from under the water and the surface floating portion of the self rescue.

It is another object of the invention that the inflatable retrieval device contain a pressure bleed valve to allow elimination of pressurized gas from the inflatable retrieval device if desired.

Yet another and related object of the invention is that a new unused gas cartridge can be readily installed.

The invention will be better understood upon reference to the drawings and detailed description of the invention which follow in which:

DETAILED DESCRIPTION

Figure 1:
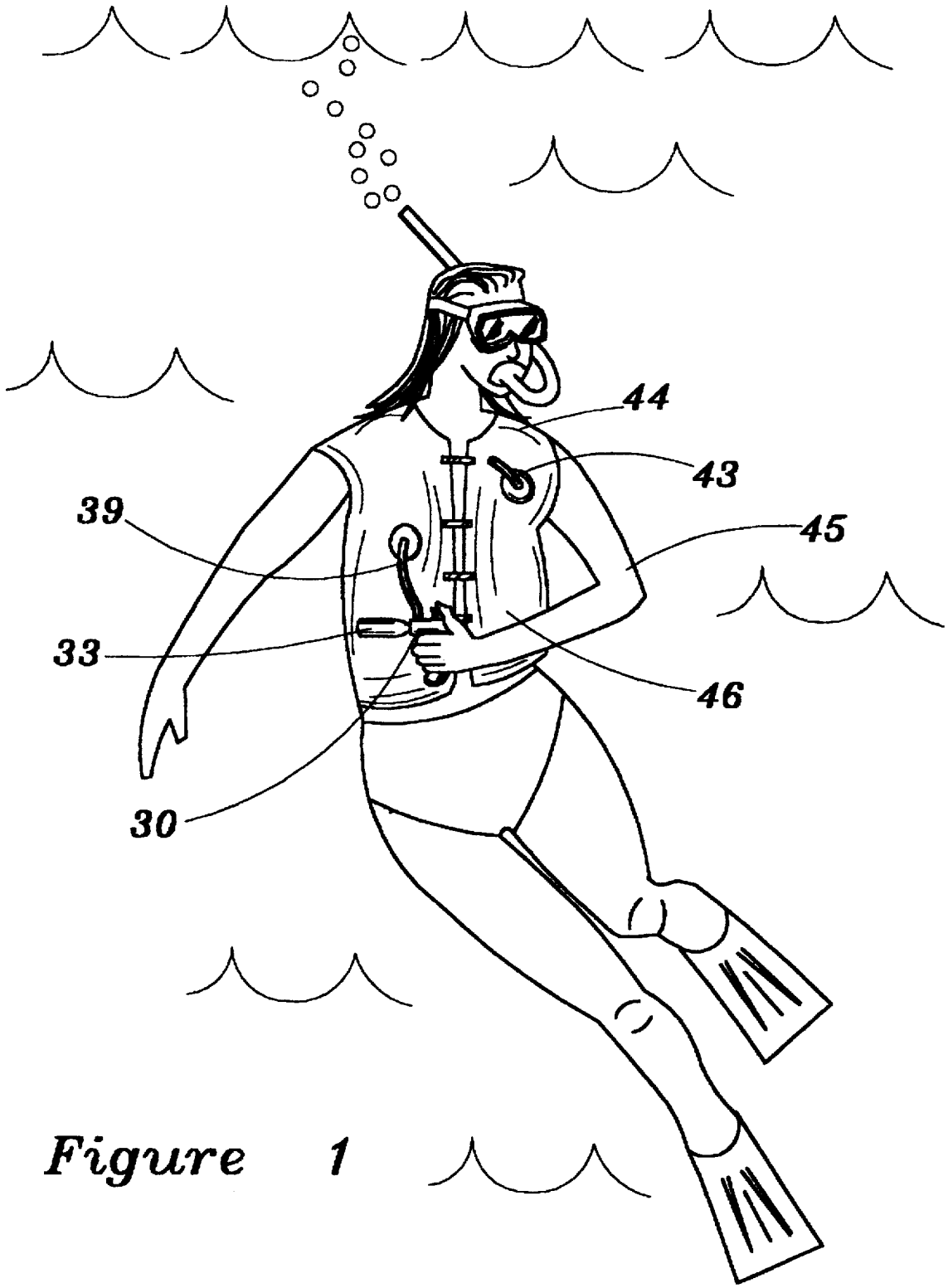
FIG. 1 presents a drawing of a free diver wearing the inventive self-rescue system. In this instance the diver is ascending from a dive with her left hand having actuated the trigger mechanism. Note that if the diver should be rendered unconscious by SWB or other disability that her grip on the trigger would be released and the ergonomically designed bladder garment would be automatically inflated thus bring her safely to the surface where she would float face up due to the bladder garment's design.

FIG. 1 shows a free-diver 45 during ascent from a dive while wearing the instant invention free-diver permanently wearable self-rescue system 46. In this proper application of the invention, the diver has her hand on the actuator 30 which puts it in the armed position. If she should lose consciousness due to shallow water blackout or for any other reason or become otherwise disabled, her hand would lose its grip and a puncture pin would puncture the CO2 cylinder 33 thus inflating the bladder garment 44 through gas tube 39. Also shown is a tie strap 49 and a bladder vent valve 43.

The design of the bladder garment 44 is especially made to normally have two essentially vertical bladder elements 47 and 48, one on each side in front in the pectoral parallel positions, and a preferably horizontally oriented rear bladder element, not shown, positioned behind the diver's neck and spreading from shoulder blade to shoulder blade. This rear bladder is normally wider behind the head at the neck level. This special positioning of the bladders insures proper back down head up orientation of a disabled diver's body when he or she reaches the water surface. An added feature is a cartridge belt 50 for spare CO2 cartridges that can be provided.

Figure 2:
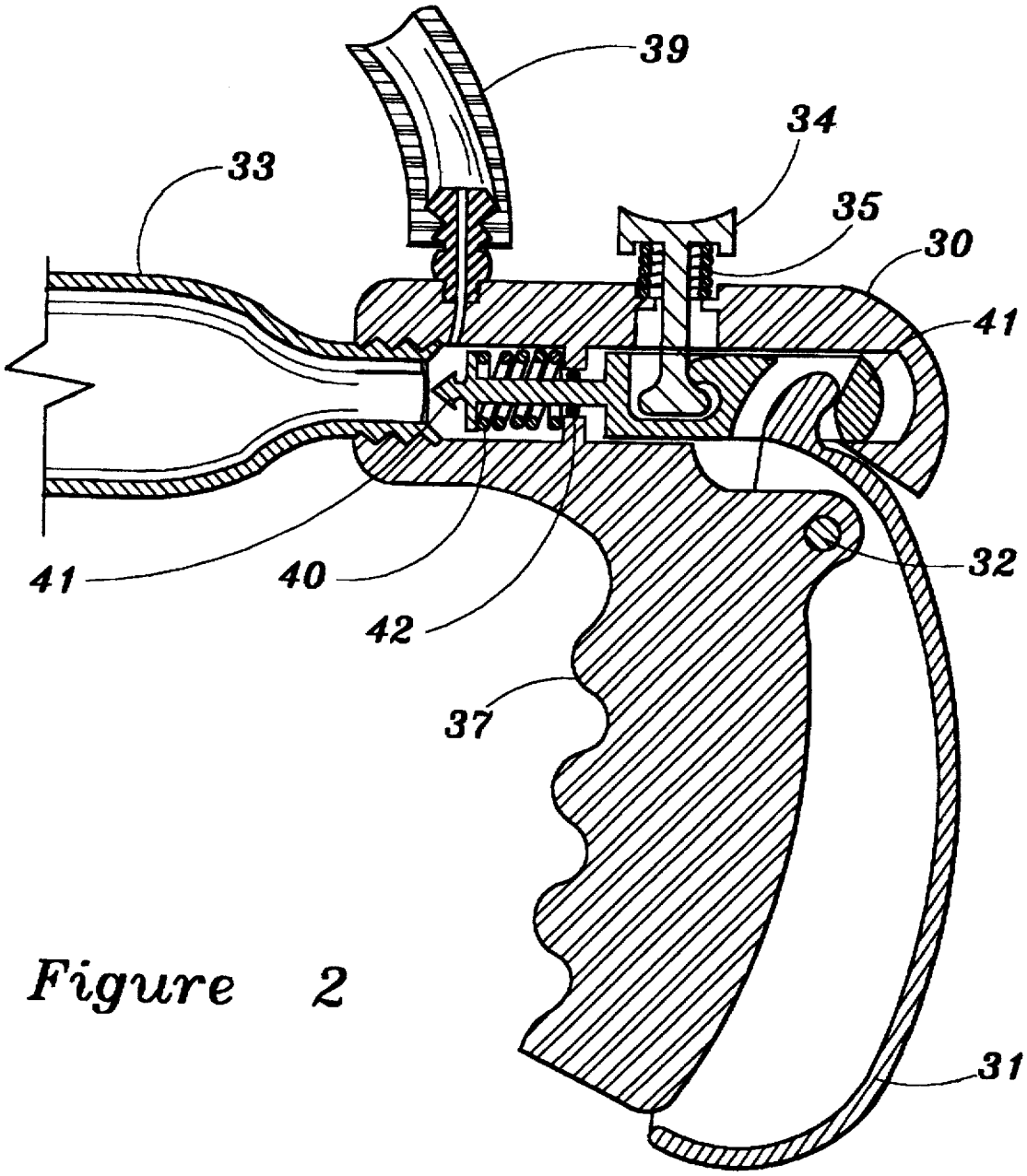
FIG. 2 shows a centerline cross sectional view of the instant invention's trigger mechanism that shows details of the gas cartridge trigger assembly in the standby or locked position. Note that the puncture pin assembly is locked from moving by the locking mechanism in this instance.

FIG. 2 presents a centerline cross sectional view of the actuator assembly 30 that shows the puncture pin rod 41, puncture pin actuation spring 40, O-ring seal 42, locking pin 34, locking pin spring 35, main housing 37, trigger handle 31, trigger handle pin 32, CO2 or other gas cartridge 33, and gas tubing 39 that connects to the inflatable bladder garment. In this example, the actuator is in the standby or locked mode since the locking pin 32 is inset into the puncture pin rod 41 such that it renders it immobile or locked.

Figure 3:
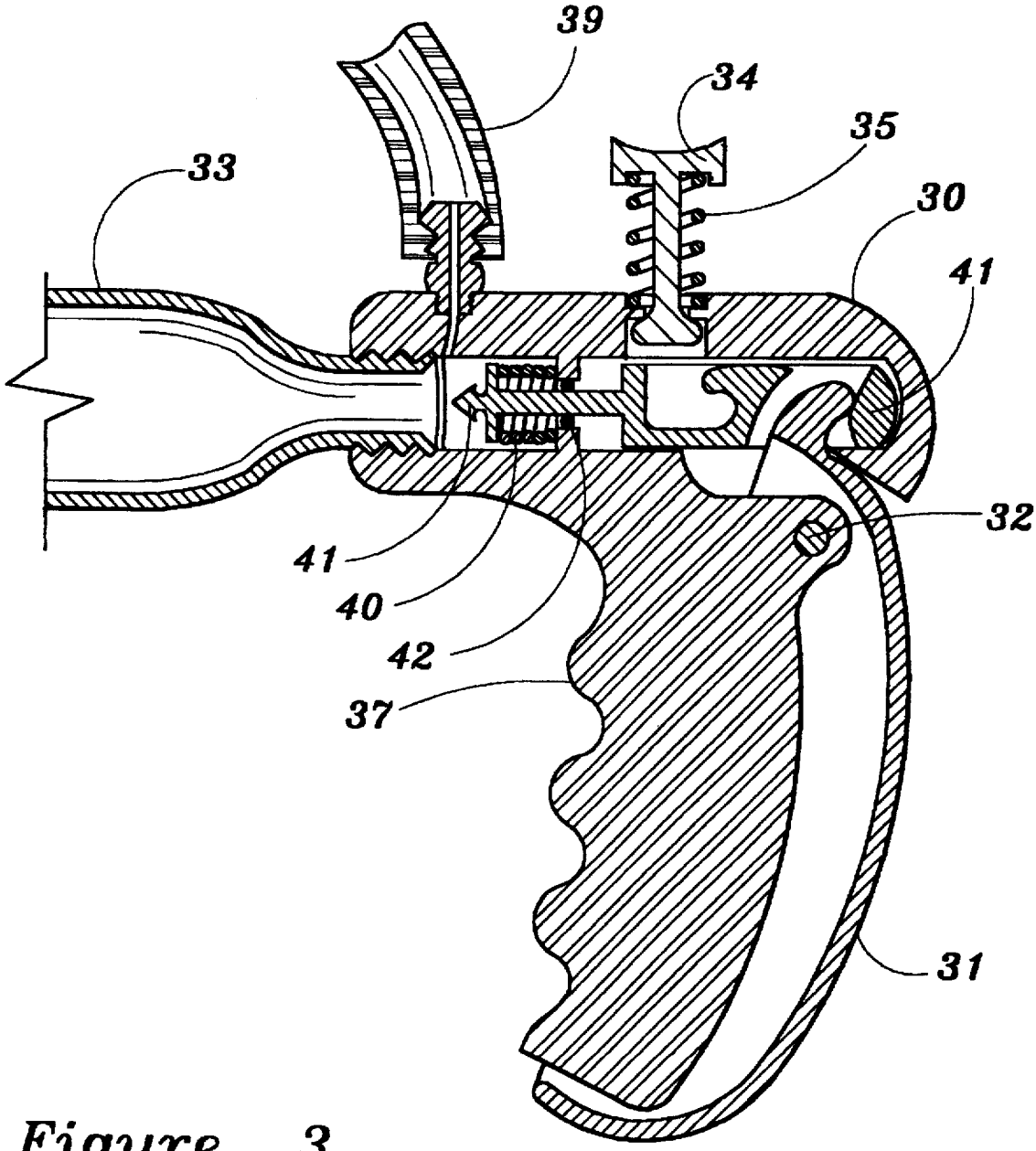
FIG. 3 presents the same centerline cross sectional view as FIG. 2 but with the trigger mechanism cocked as its trigger handle is engaged by the diver's hand. The diver's hand is not shown but it is to be realized the palm of the diver's hand is on the rear portion of the trigger lever mechanism and the diver's fingers are positioned in the finger grips in the main handle portion. So long as the diver maintains his or her grip so that the trigger handle is squeezed forward the puncture pin mechanism will stay in this position. Assuming the diver reaches the water surface safely, he or she will simply press the spring loaded locking mechanism back into the slot in the puncture pin mechanism which returns the mechanism to the standby position as was shown in FIG. 1.

FIG. 3 is the same cross sectional view as presented in FIG. 2 but with the trigger handle 31 rotated forward by manual force means, not shown, such as one of the diver's hands. Note that the puncture pin rod 41 is moved further back than is the case of the standby position of FIG. 2. The movement of the puncture pin rod 41 rearward frees the locking pin 34 such that it is then powered upward and out of the way by resilient biasing means such as locking spring pin 35. Note that, while not shown, numerous other means of providing locking pin movement fore, including manual or artificially powered means, are considered quite within the scope of the invention.

The action shown in FIG. 3 is the same, but reversed, from the action required to reinsert the locking pin 34 into the puncture pin rod 41. This reinsertion of the locking pin 34 places the system in its standby mode where it is ready for the next dive. Locking pin 34 can be reset into its locked position by the diver while using only one hand.

Figure 4:
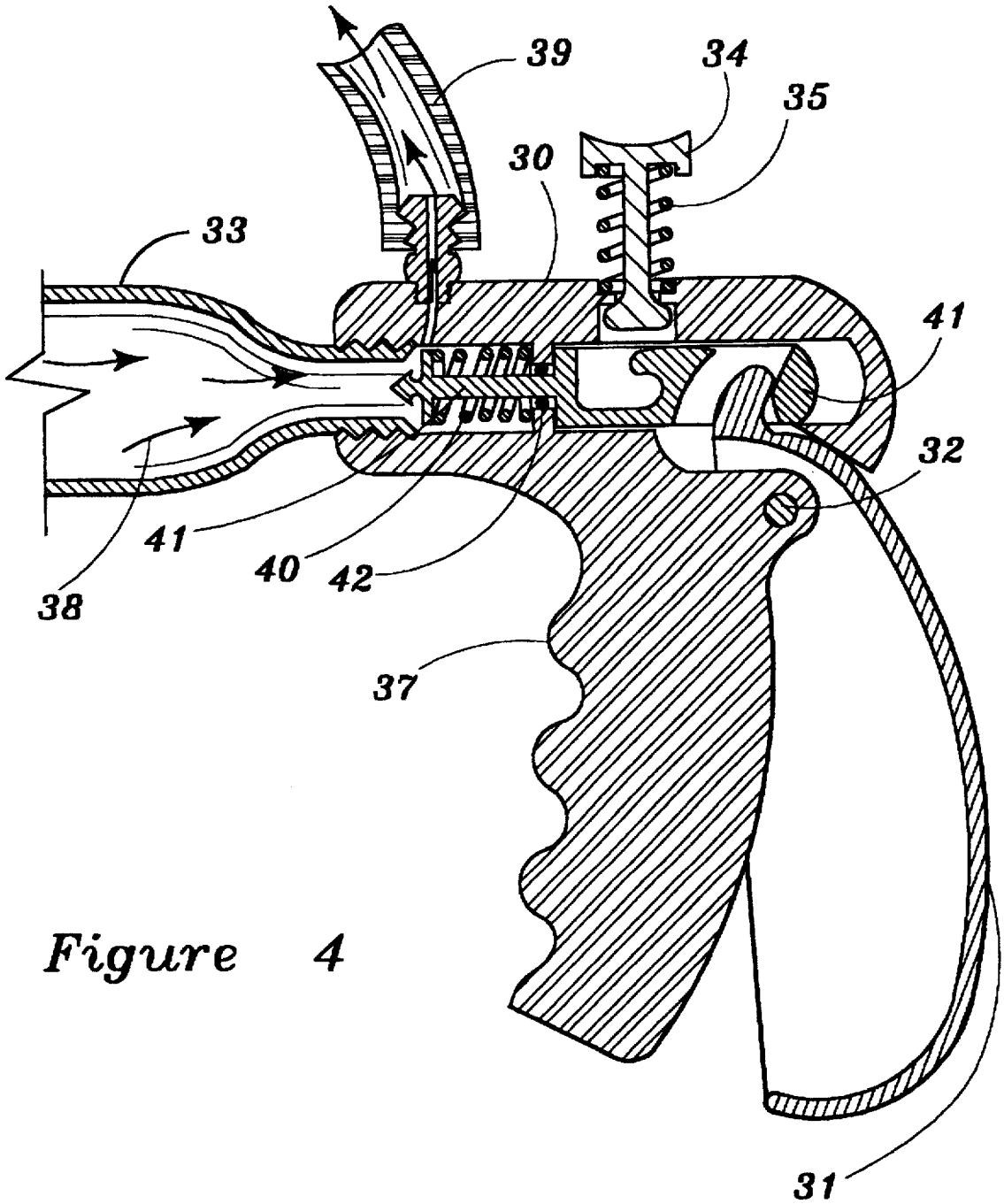
FIG. 4 is, again, the same centerline cross sectional view as shown in FIG. 2 but with the trigger handle released as would be the case of the diver being rendered unconscious or otherwise disabled. Note that the puncture pin mechanism has now been propelled forward so that the cap on the gas cartridge is ruptured. This obviously released the pressurized gas thereby inflating the inflatable bladder garment.

FIG. 4 shows the diver failure mode of operation that would occur if the diver is incapacitated for any reason such as becoming unconscious and releases the trigger handle 31. In such case, the puncture pin actuation spring 40 propels the puncture pin 42 forward so that it punctures the end of the gas cartridge 33. This action results in pressurized gas being directed out the gas tube 39 and then to the inflatable bladder garment.

While the invention has been described in connection with a preferred and several alternative embodiments, it will be understood that there is no intention to thereby limit the invention. On the contrary, there is intended to be covered all alternatives, modifications and equivalents as may be included within the spirit and scope of the invention as defined by the appended claims which are the sole definition of the invention.

What I claim is:

1. In an improved life saving device intended primarily for divers, the improvement comprising:

an inflatable bladder garment that the diver wears when diving with said bladder garment having low hydrodynamic resistance when the diver is underwater, a pressurized gas cartridge for inflating the bladder garment that, when the gas cartridge is punctured, is in gaseous communication with the bladder garment, means for the diver to arm and then restrain manually a trigger mechanism wherein said trigger mechanism restrains a resiliently biased gas cartridge puncture mechanism such that if the diver should release the trigger mechanism the gas cartridge is punctured by the action of the then released puncture mechanism allowing pressurized gas to pass to and inflate the bladder garment with the diver either under water or on the water surface, a gas cartridge penetration mechanism lock that, when in its locked position, restrains the penetration mechanism from penetrating the pressurized gas cartridge, and wherein the penetration mechanism lock is automatically unlocked by release of a locking mechanism upon the diver's manual arming of the trigger mechanism.

2. The improved life saving device of claim 1 wherein the bladder garment comprises at least two front bladder elements oriented primarily vertically.

3. The improved life saving device of claim 1 which further comprises a cartridge belt for carrying spare pressurized gas cartridges.

4. The improved life saving device of claim 1 wherein the penetration mechanism lock, an intrinsic part of the improved life saving device, can be reset into its locked position by the diver while using only one hand.

5. The improved life saving device of claim 1 wherein at least a portion of a force required to automatically release the locking mechanism is provided by a resilient bias force member.

6. The improved life saving device of claim 1 which further comprises a gas venting means to allow venting of gas pressure from the bladder garment.

7. In an improved life saving device intended for aquatic pursuits, the improvement comprising:

an inflatable body fitting bladder garment that may be worn by a water sports person either on the surface of the water or when diving underwater, a pressurized gas cartridge for inflating the bladder garment that, when the pressurized gas cartridge is punctured by a resiliently biased puncture pin mechanism, is in gaseous communication with the bladder garment, a locking means to lock the resiliently biased puncture pin mechanism such that it cannot puncture the pressurized gas cartridge, a trigger mechanism in mechanical communication with the puncture pin mechanism such that, with the locking means disabled, the trigger mechanism, so long as manually held in position, can restrain the puncture pin mechanism such that it does not puncture the pressurized gas cartridge, and whereby, with the locking means disabled, releasing of the manually held trigger mechanism results in the puncture pin puncturing the pressurized gas cartridge so that pressurized gas is supplied to the bladder garment, and wherein the locking means is automatically unlocked upon the manual energizing of the trigger mechanism.

8. The improved life saving device of claim 7 wherein the locking means, an intrinsic part of the life saving device, can be reset into its locked position by the water sports person using only one hand.

9. The improved life saving device of claim 7 wherein a force for automatically unlocking the locking means is a resilient biased force.

10. The improved life saving device of claim 7 wherein the bladder garment comprises at least two front bladder elements oriented primarily vertically.

11. The improved life saving device of claim 7 which further comprises a cartridge belt for carrying spare pressurized gas cartridges.

12. The improved life saving device of claim 7 which further comprises a pressure vent valve for venting gas pressure from the bladder garment.

13. The improved life saving device of claim 7 wherein the bladder garment is of a shape to provide low hydrodynamic resistance when worn by a diver underwater.

14. In an improved life saving device intended for use by a user involved in aquatic pursuits, the improvement comprising:

an inflatable body fitting bladder garment for divers that provides a minimum of underwater hydrodynamic resistance, a pressurized gas cartridge capable of, when punctured, supplying pressurized gas to and thereby inflating the body fitting bladder garment, a resiliently biased puncture pin capable of puncturing the pressurized gas cartridge, a restraining lock for locking the puncture pin such that it cannot penetrate the gas cartridge, a manually operated trigger mechanism that, when manually energized and with the puncture pin lock disabled, restrains the puncture pin from puncturing the pressurized gas cartridge, and whereby if the user should manually release the trigger mechanism the puncture pin is propelled by its resilient biased force means such that it penetrates the pressurized gas cartridge so that pressurized gas is directed to the bladder garment to thereby inflate said bladder garment, and wherein the restraining lock is automatically unlocked upon the diver's manual arming of the trigger mechanism.

15. The improved life saving device of claim 14 wherein the bladder garment comprises at least two front bladder elements oriented primarily vertically.

16. The improved life saving device of claim 14 which further comprises a cartridge belt for carrying spare pressurized gas cartridges.

17. The improved life saving device of claim 14 wherein the restraining lock, an intrinsic part of the improved life saving device, can be reset into its locked position by the diver while using only one hand.

18. The improved life saving device of claim 14 wherein the restraining lock is resiliently biased.

19. The improved life saving device of claim 14 which further comprises a pressure vent valve for venting gas pressure from the bladder garment.

* * * * *

UNITED STATES PATENT AND TRADEMARK OFFICE

CERTIFICATE OF CORRECTION

PATENT NO. : 5,800,228

DATED : SEP. 01, 1998

INVENTOR(S) : Ricardo G. Hernandez

It is certified that error appears in the above-identified patent and that said Letters Patent is hereby corrected as shown below:

Title page, item [54] and Col. 1, line 1 should read --
FREE-DIVER PERMANENTLY WEARABLE SELF-RESCUE SYSTEM Signed and Sealed this Twenty-second Day of December, 1998

*Attest:*

*Attesting Officer*

BRUCE LEHMAN

*Commissioner of Patents and Trademarks*